US010316555B2

(12) United States Patent
Stephens

(10) Patent No.: US 10,316,555 B2
(45) Date of Patent: Jun. 11, 2019

(54) TRUCK ROLL-UP DOOR INTERNAL LOCK RELEASE

(71) Applicant: ROM Acquisition Corporation, Belton, MO (US)

(72) Inventor: Richard D. Stephens, Independence, MO (US)

(73) Assignee: ROM Acquisition Corporation, Belton, MO (US)

( * ) Notice: Subject to any disclaimer, the term of this patent is extended or adjusted under 35 U.S.C. 154(b) by 311 days.

(21) Appl. No.: 15/263,303

(22) Filed: Sep. 12, 2016

(65) Prior Publication Data

US 2017/0081886 A1 Mar. 23, 2017

Related U.S. Application Data

(60) Provisional application No. 62/220,893, filed on Sep. 18, 2015.

(51) Int. Cl.

| | |
|---|---|
| ***E05B 83/04*** | (2014.01) |
| ***E05C 9/04*** | (2006.01) |
| ***E05B 65/00*** | (2006.01) |
| ***E05B 77/30*** | (2014.01) |
| ***E05B 79/20*** | (2014.01) |

(52) U.S. Cl.

CPC ..... *E05B 83/04* (2013.01); *E05B 65/0021* (2013.01); *E05B 77/30* (2013.01); *E05B 79/20* (2013.01); *E05C 9/047* (2013.01)

(58) Field of Classification Search

CPC ..... E05B 65/0021; E05B 67/383; E05B 2067/386; E05B 83/04; E05B 77/30; E05B 79/20; E05C 9/047

USPC ..... 70/95–100, 465; 292/67, 146, 148, 143, 292/152, 244, 205, 238, 245, 340, 341.11, 292/341.12, 341.13, 341.17, DIG. 65, 292/DIG. 36

See application file for complete search history.

(56) References Cited

U.S. PATENT DOCUMENTS 2,329,348 A * 9/1943 Honig ..... E05B 65/0021 292/125
2,618,498 A * 11/1952 Schlesser ..... E05B 63/246 292/340
2,708,478 A * 5/1955 Wolf ..... E05B 65/0021 160/191
2,988,909 A * 6/1961 Moler ..... E05B 65/0021 160/191
3,085,297 A * 4/1963 Linderfelt ..... B64C 1/1407 244/129.5

(Continued)

*Primary Examiner* — Suzanne L Barrett

(74) *Attorney, Agent, or Firm* — Wei Wei Jeang; Grable Martin Fulton PLLC

(57) ABSTRACT

An internal release mechanism for a truck roll-up door closure to a vehicle compartment includes a lift arm disposed on the roll-up door inside the vehicle compartment having a stowed position and a deployed position, a first release mechanism coupled to the lift arm operable to bypass a door lock disposed outside the vehicle compartment in response to the lift arm being moved by an occupant inside the vehicle compartment from the stowed position to the deployed position, and a second release mechanism coupled to the lift arm operable to clear a mechanical door latch disposed outside of the vehicle compartment also in response to the lift arm being moved from the stowed position to the deployed position.

7 Claims, 13 Drawing Sheets

(56) References Cited

U.S. PATENT DOCUMENTS

| | | | | | |
|---|---|---|---|---|---|
| 3,190,347 | A * | 6/1965 | Lee | E05F 13/04 | 160/189 |
| 3,285,646 | A * | 11/1966 | Foss | E05B 65/0021 | 292/133 |
| 3,325,203 | A * | 6/1967 | Moler | E05B 47/0047 | 292/201 |
| 3,346,288 | A * | 10/1967 | Cosentino | E05B 53/001 | 292/255 |
| 3,352,585 | A * | 11/1967 | Crosswell | E05B 65/0053 | 292/113 |
| 3,838,877 | A * | 10/1974 | Hanson | E05B 65/0021 | 292/134 |
| 3,871,694 | A * | 3/1975 | White | E05B 65/0053 | 292/218 |
| 4,461,160 | A * | 7/1984 | Van Gompel | E05C 1/08 | 292/171 |
| 4,480,863 | A * | 11/1984 | Hormann | E05B 65/0021 | 292/207 |
| 6,427,500 | B1 * | 8/2002 | Weinerman | B60J 7/198 | 292/196 |
| 6,959,846 | B2 * | 11/2005 | Schomaker | B60P 3/075 | 220/324 |
| 7,114,753 | B2 * | 10/2006 | Nodorft | E05B 47/0002 | 292/137 |
| 7,510,224 | B2 * | 3/2009 | Bacco | E05B 53/003 | 292/340 |
| 7,600,344 | B2 * | 10/2009 | Michaud | E05D 13/006 | 49/322 |
| 8,789,859 | B2 * | 7/2014 | Curtis | E05B 15/0295 | 292/201 |
| 9,777,512 | B2 * | 10/2017 | Curtis | E05B 65/0021 | |
| 2003/0047949 | A1 * | 3/2003 | Brunner | E05B 63/246 | 292/163 |

* cited by examiner

TRUCK ROLL-UP DOOR INTERNAL LOCK RELEASE

RELATED APPLICATION

This patent application claims the benefit of U.S. Provisional Patent Application No. 62/220,893 filed on Sep. 18, 2015.

BACKGROUND

Many commercial trucks and trailers and fire and emergency vehicles deployed on the road today are equipped with roll-up doors. These doors are constructed of a plurality of horizontal interlocked slats that travel up and down guide tracks along the vertical sides of the door frame. These roll-up doors may be constructed to suit a variety of applications and environments and may include a locking mechanism to secure the door.

DETAILED DESCRIPTION

Figure 1:
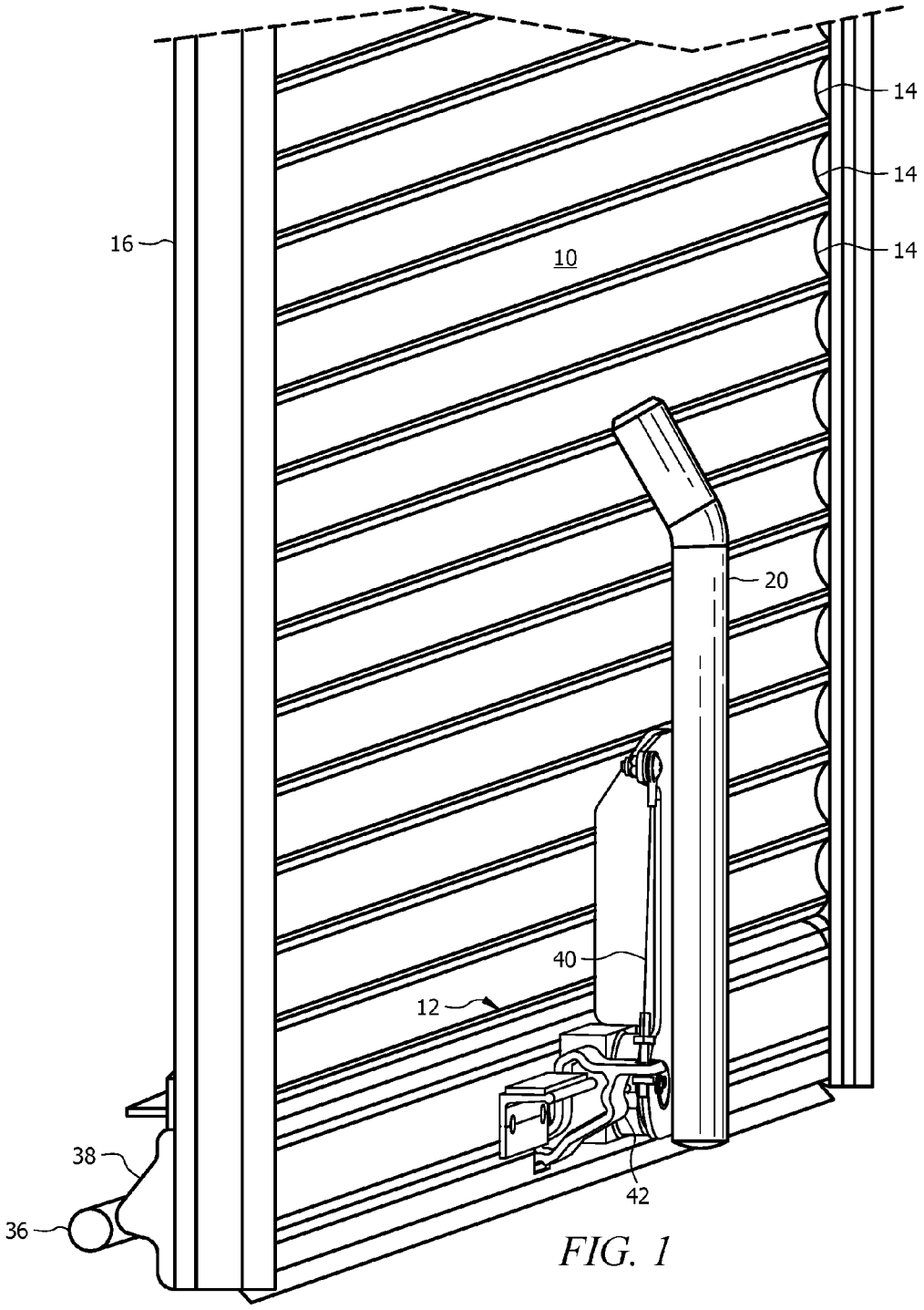
FIG. 1 is a perspective view of an exemplary embodiment of an inside view of a roll-up door equipped with an internal lock release according to the present disclosure.
Figure 2:
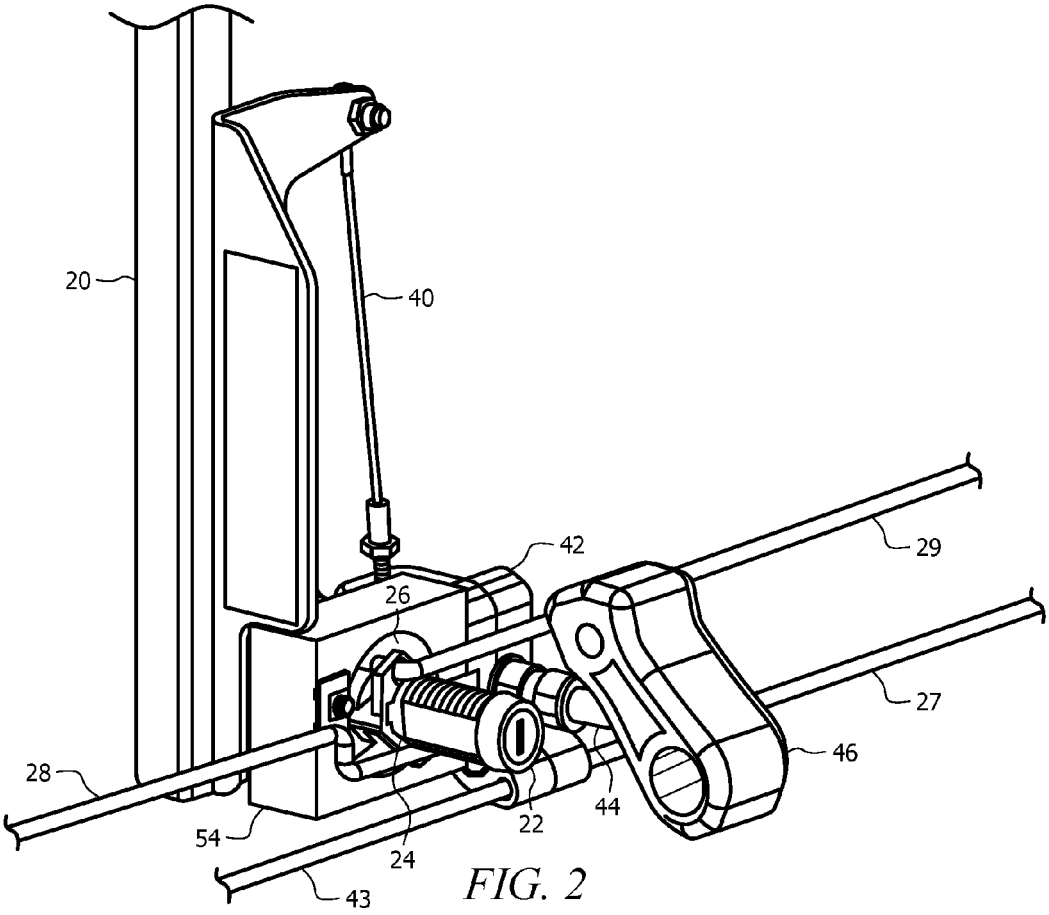
FIG. 2 is a more detailed perspective view of an exemplary embodiment of the internal lock release in its deployed position viewed from outside the cargo compartment with the roll-up door and the lift bar hidden from view for the sake of an unobstructed view according to the present disclosure.
Figure 3:
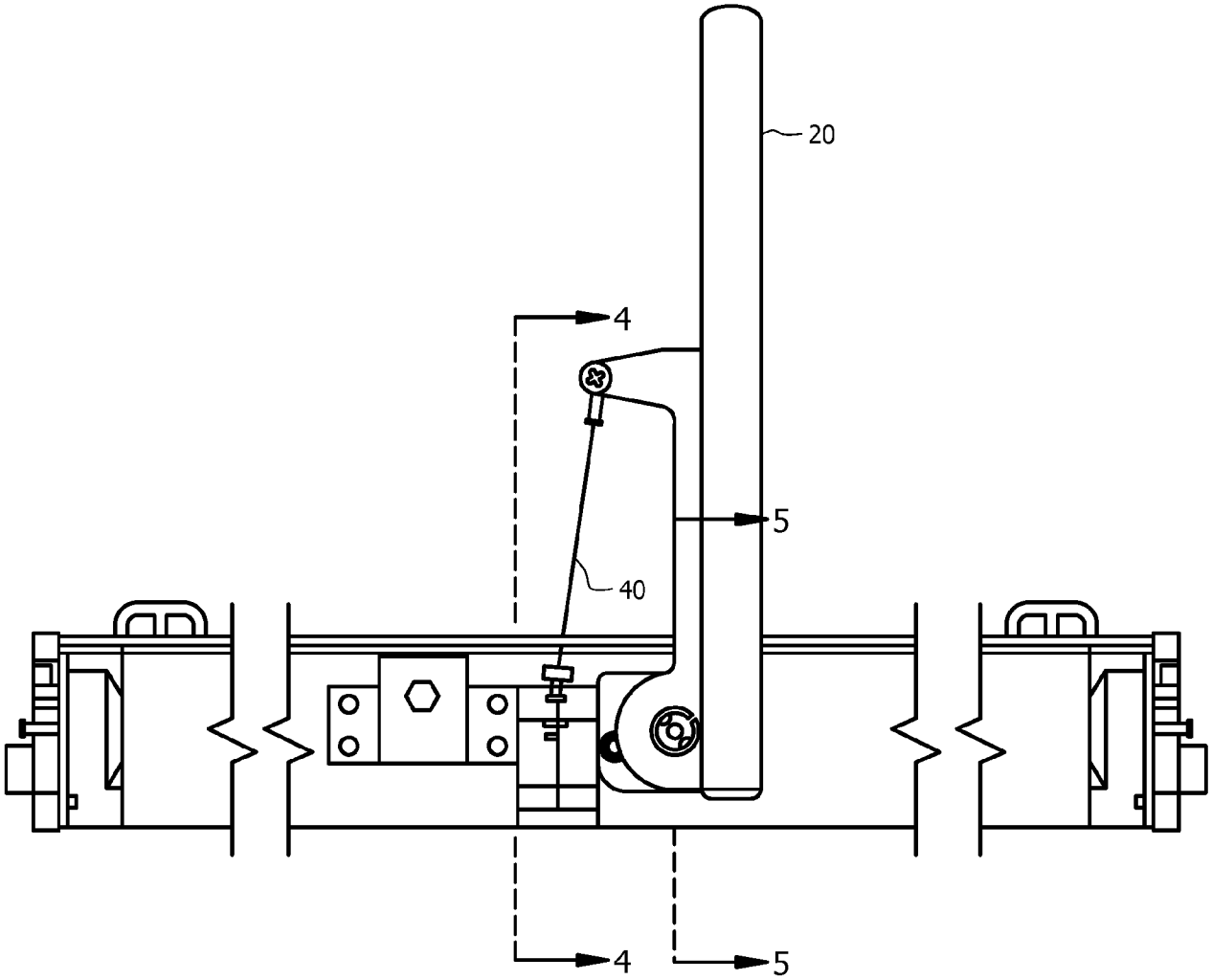
FIG. 3 is a more detailed front view of an exemplary embodiment of the internal lock release in its deployed position with the roll-up door hidden from view for the sake of an unobstructed view according to the present disclosure.
Figure 4:
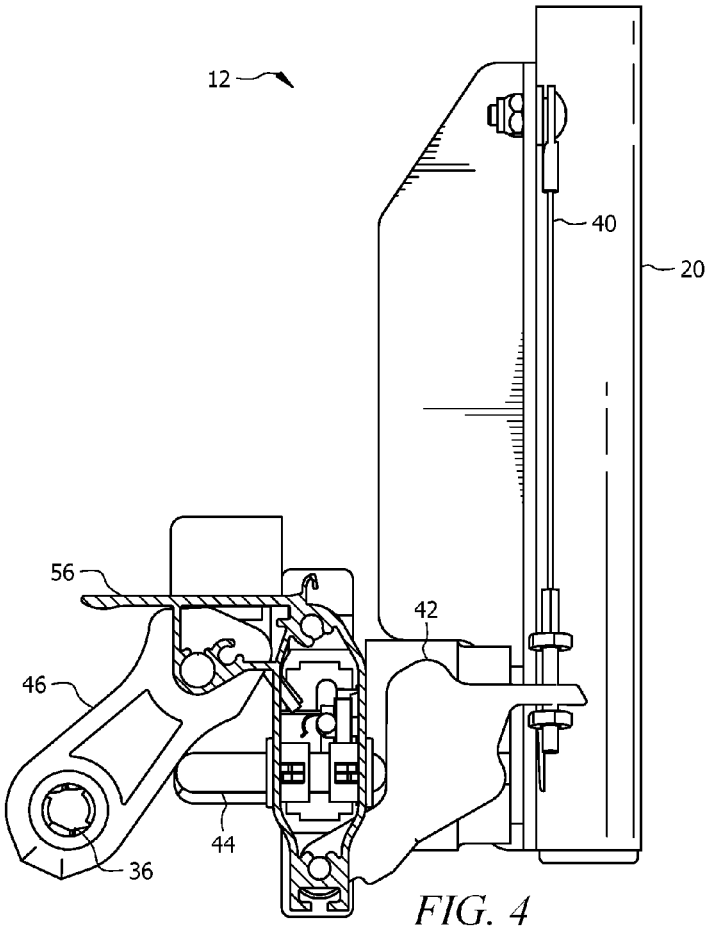
FIG. 4 is a more detailed side view of an exemplary embodiment of the internal lock release in its deployed position along line B-B in FIG. 3 with the roll-up door hidden from view for the sake of an unobstructed view according to the present disclosure.
Figure 5:
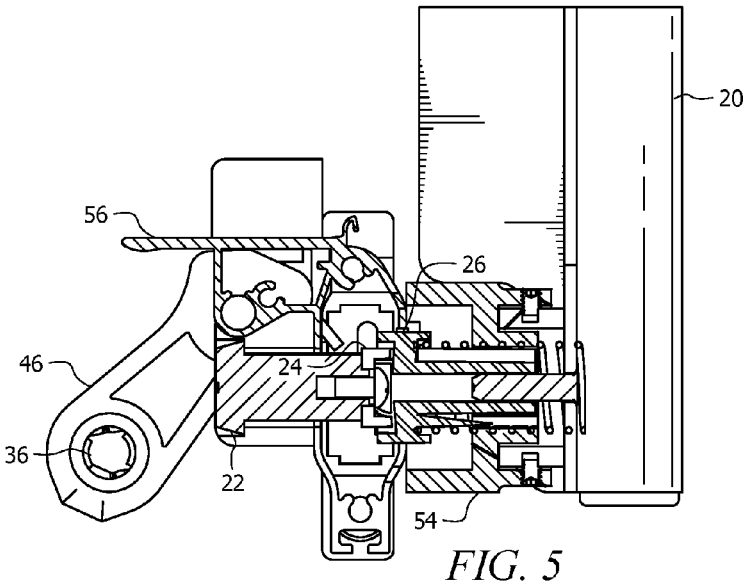
FIG. 5 is a more detailed side view of an exemplary embodiment of the internal lock release in its deployed position along line A-A in FIG. 3 with the roll-up door hidden from view for the sake of an unobstructed view according to the present disclosure.
Figure 6A:
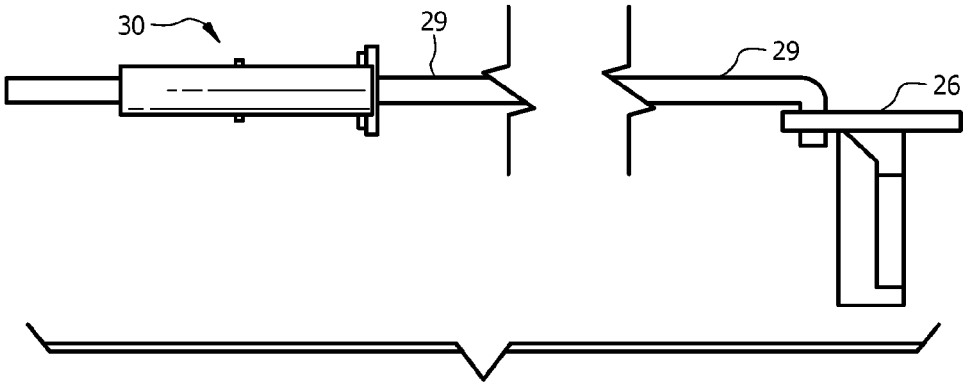
FIGS. 6A and 6B are a more detailed front partial view of an exemplary embodiment of a return ring mechanism of the internal lock release according to the present disclosure.
Figure 6B:
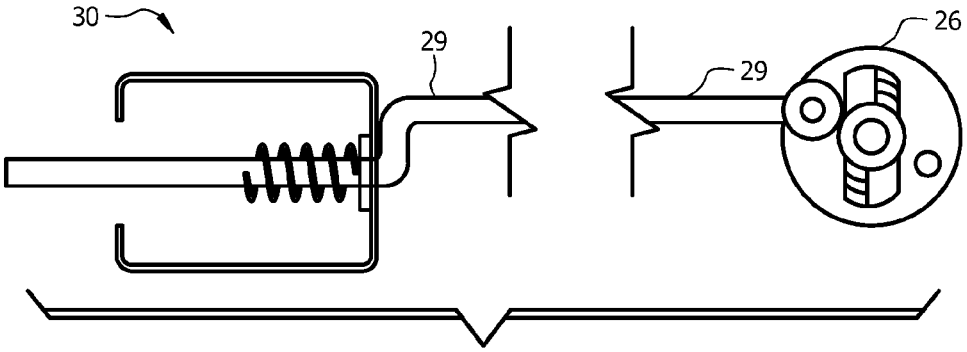
Figure 7:
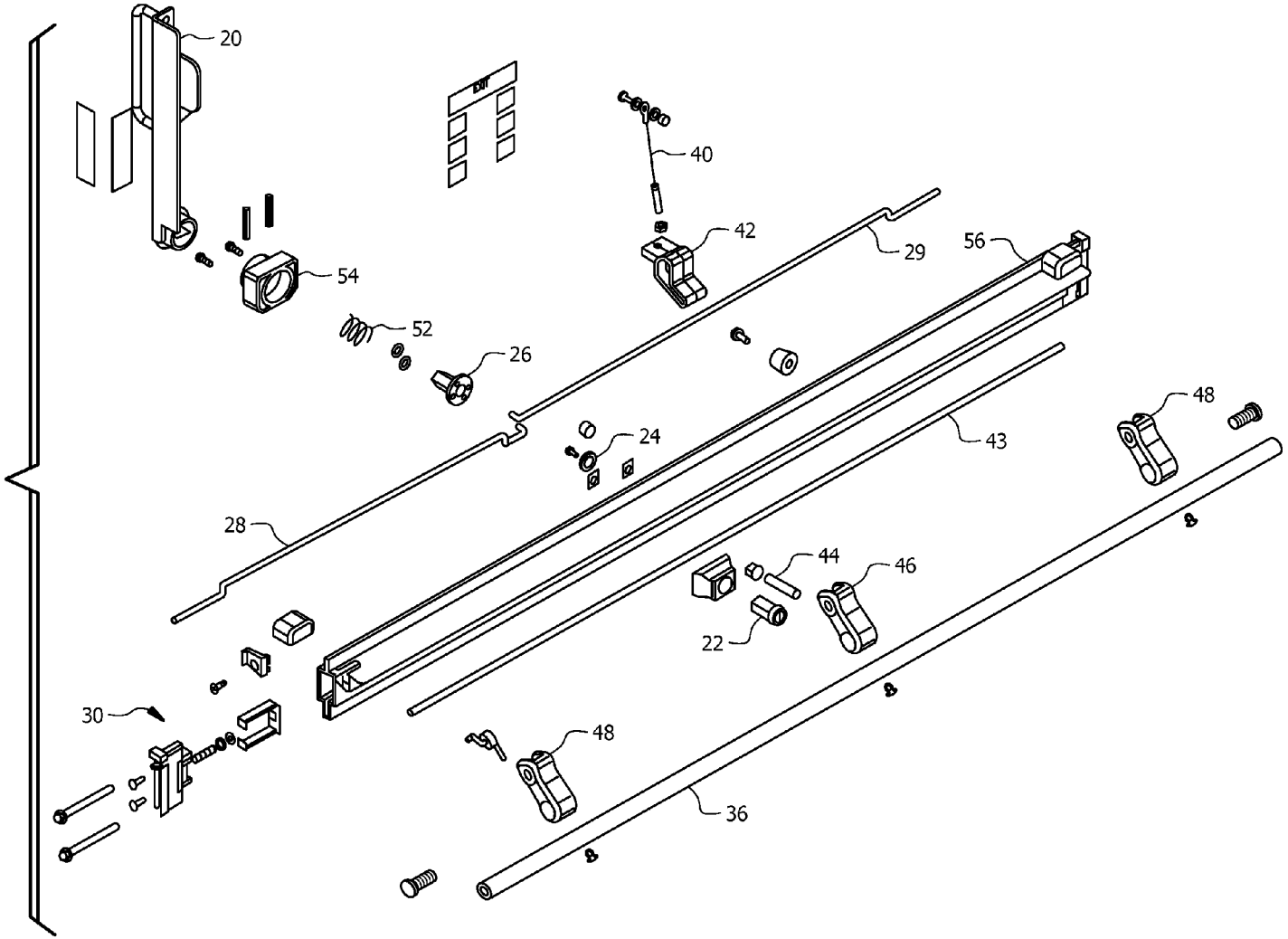
FIG. 7 is an exploded view of an exemplary embodiment of the internal lock release according to the present disclosure.
Figure 8:
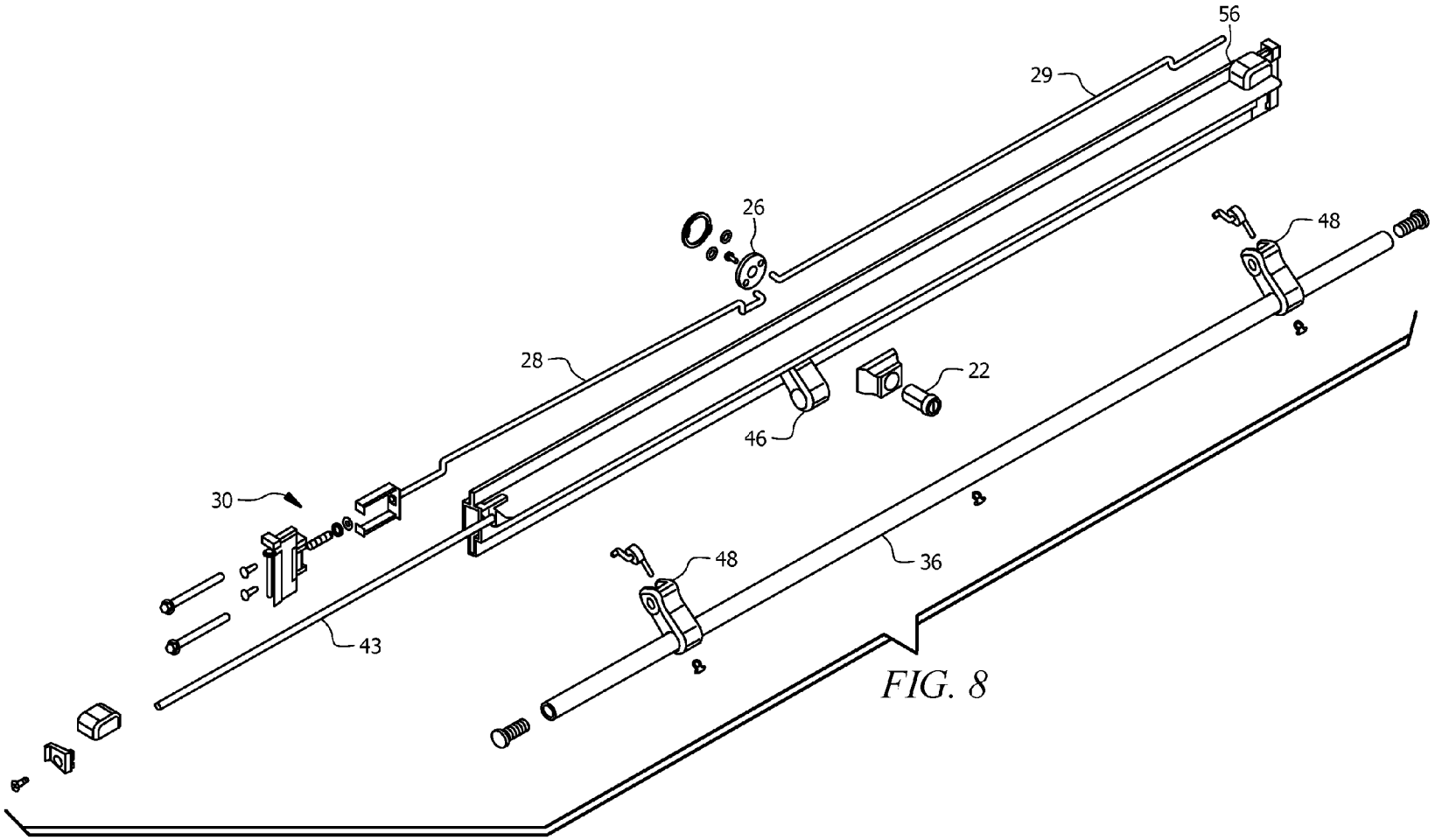
FIG. 8 is an exploded view of an exemplary embodiment of a spring assisted lock rod assembly of the internal lock release according to the present disclosure.

FIG. 1 is a perspective view of an exemplary embodiment of a roll-up door 10 equipped with an internal lock release assembly 12 viewed from inside the vehicle cargo compartment according to the present disclosure. Also called a roller shutter door, this type of doors have been deployed in work trucks, lube truck, utility truck, delivery truck, and fire and emergency vehicle applications. The roll-up door 10 is constructed of interlocked horizontal slats 14 that can be rolled up to permit unhindered access to a cargo compartment through the door opening framed by a door frame 16. Many applications of roll-up doors have a preference for the ability to lock the door to prevent unauthorized access and theft. However, conventional lockable roll-up doors do not provide a mechanism to unlock the door from the interior of the locked compartment. The internal lock release mechanism 12 described herein is a safety feature that allows an occupant inadvertently locked inside the cargo compartment to disable or unlock the external door lock from inside the compartment.

Figure 9:
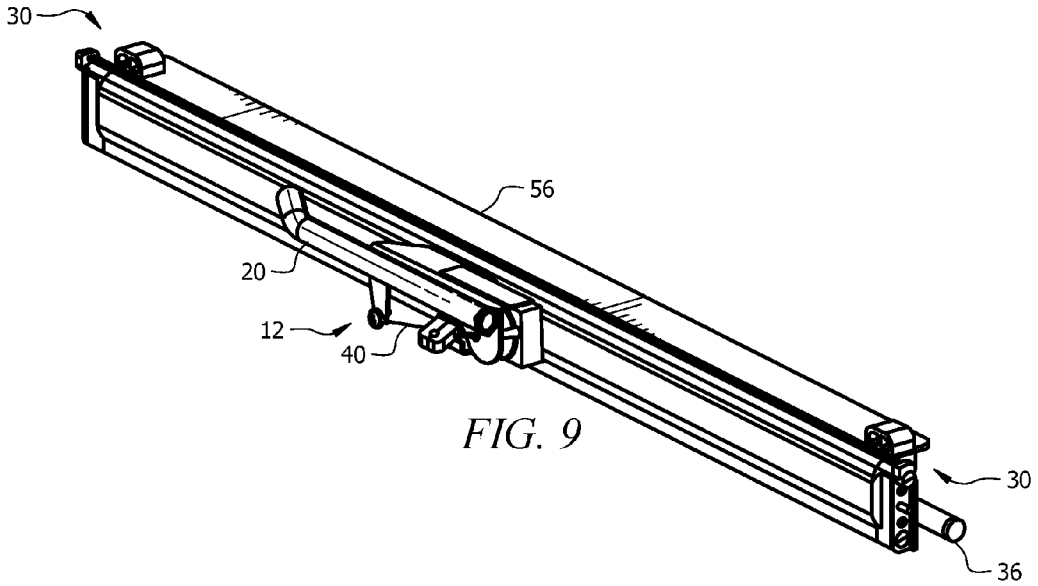
FIG. 9 is a front perspective view of an exemplary embodiment of the internal lock release in its stowed position with the roll-up door hidden from view for the sake of an unobstructed view according to the present disclosure.
Figure 10:
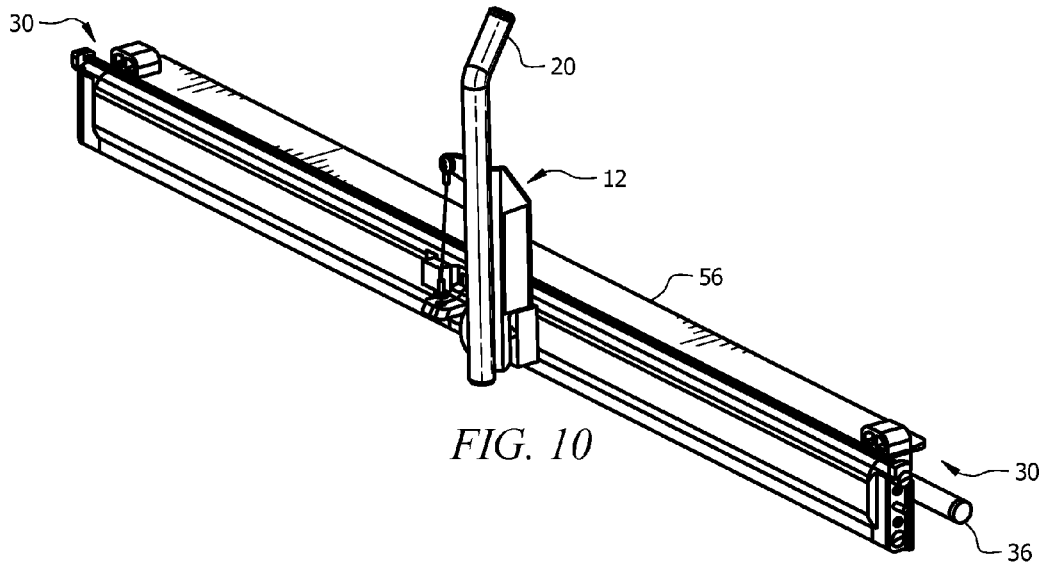
FIG. 10 is a front perspective view of an exemplary embodiment of the internal lock release in its deployed position with the roll-up door hidden from view for the sake of an unobstructed view according to the present disclosure.
Figure 11:
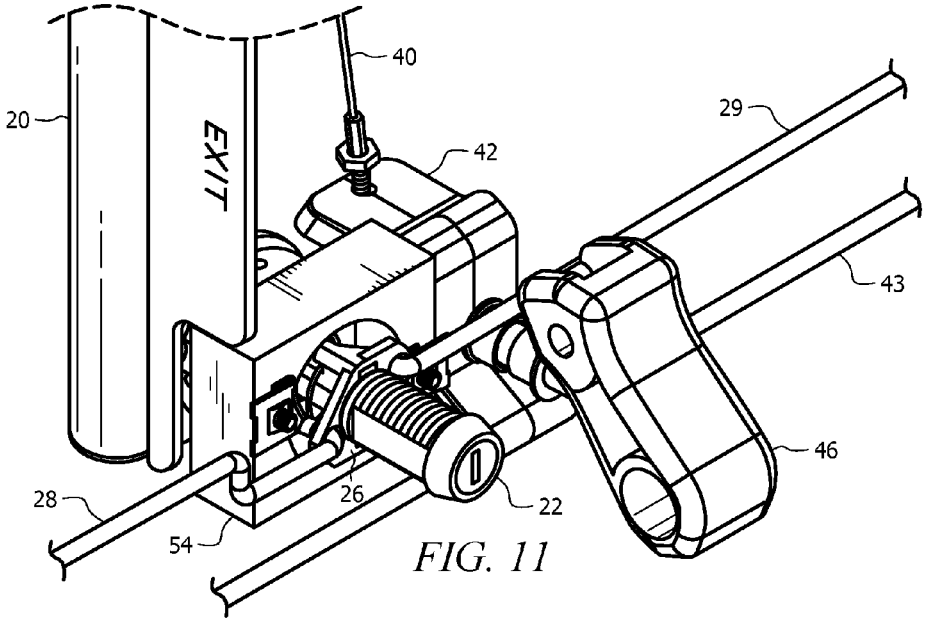
FIGS. 11 and 12 are more detailed perspective partial views showing the operations of the locking cam of the internal lock release with the roll-up door and lift bar hidden from view for the sake of an unobstructed view according to the present disclosure.
Figure 12:
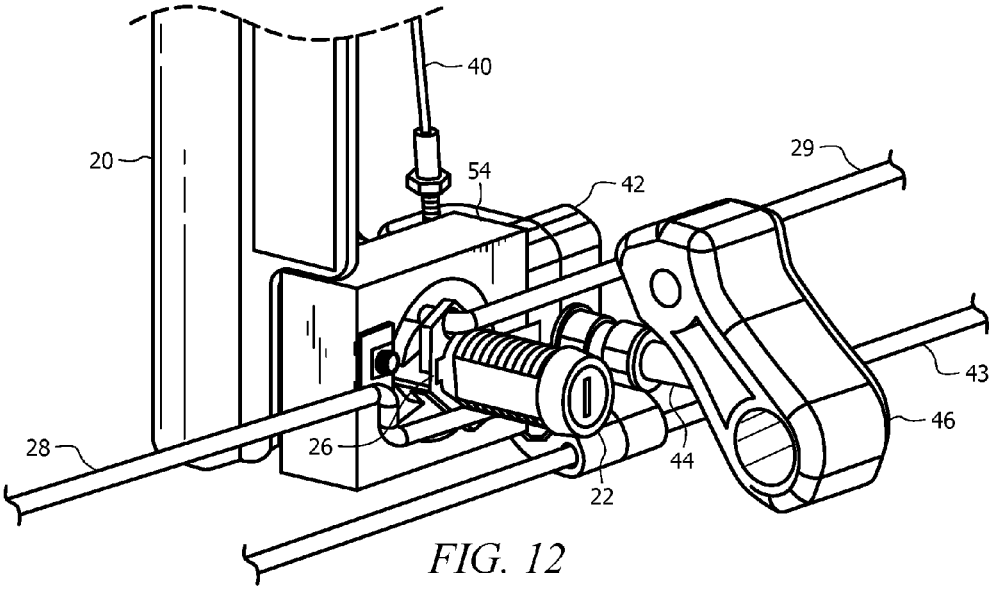
Figure 13:
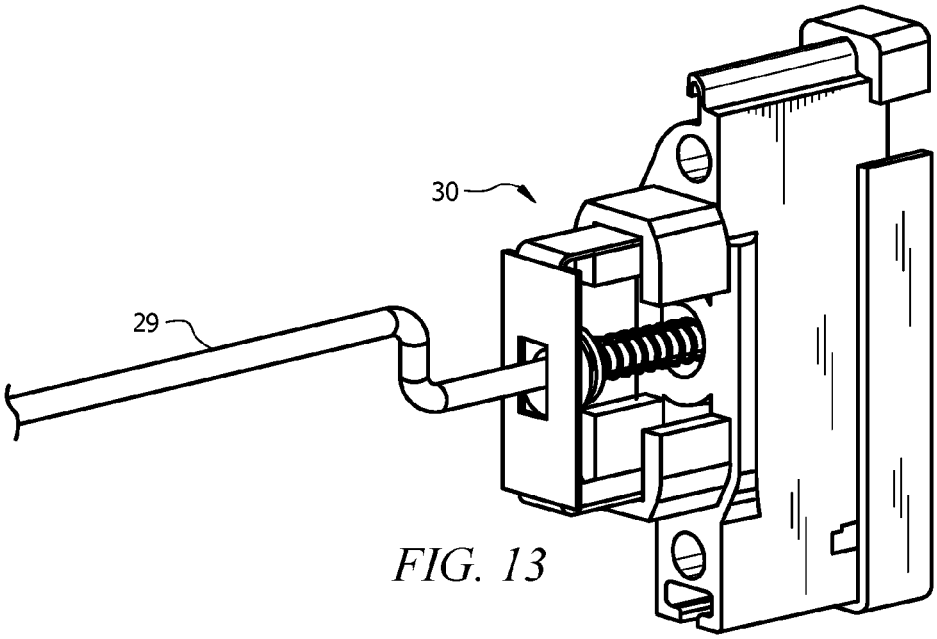
FIG. 13 is a detailed perspective view of an exemplary embodiment of the lock rod spring mechanism according to the present disclosure.
Figure 14:
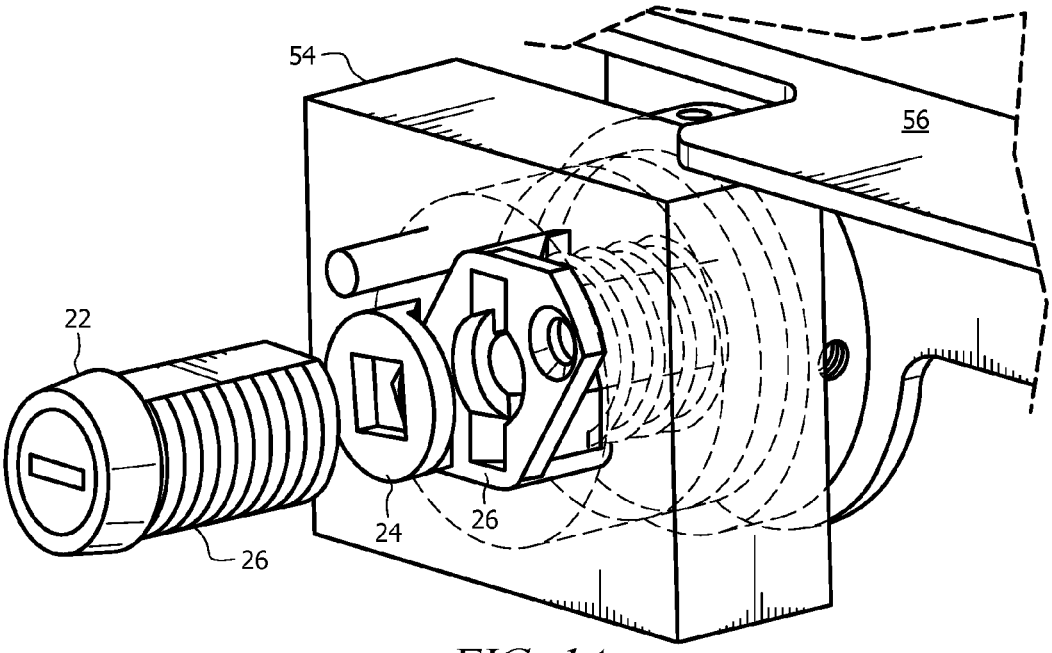
FIG. 14 is a detailed view of an exemplary embodiment of the lock cam and lock dog mechanism according to the present disclosure.
Figure 15:
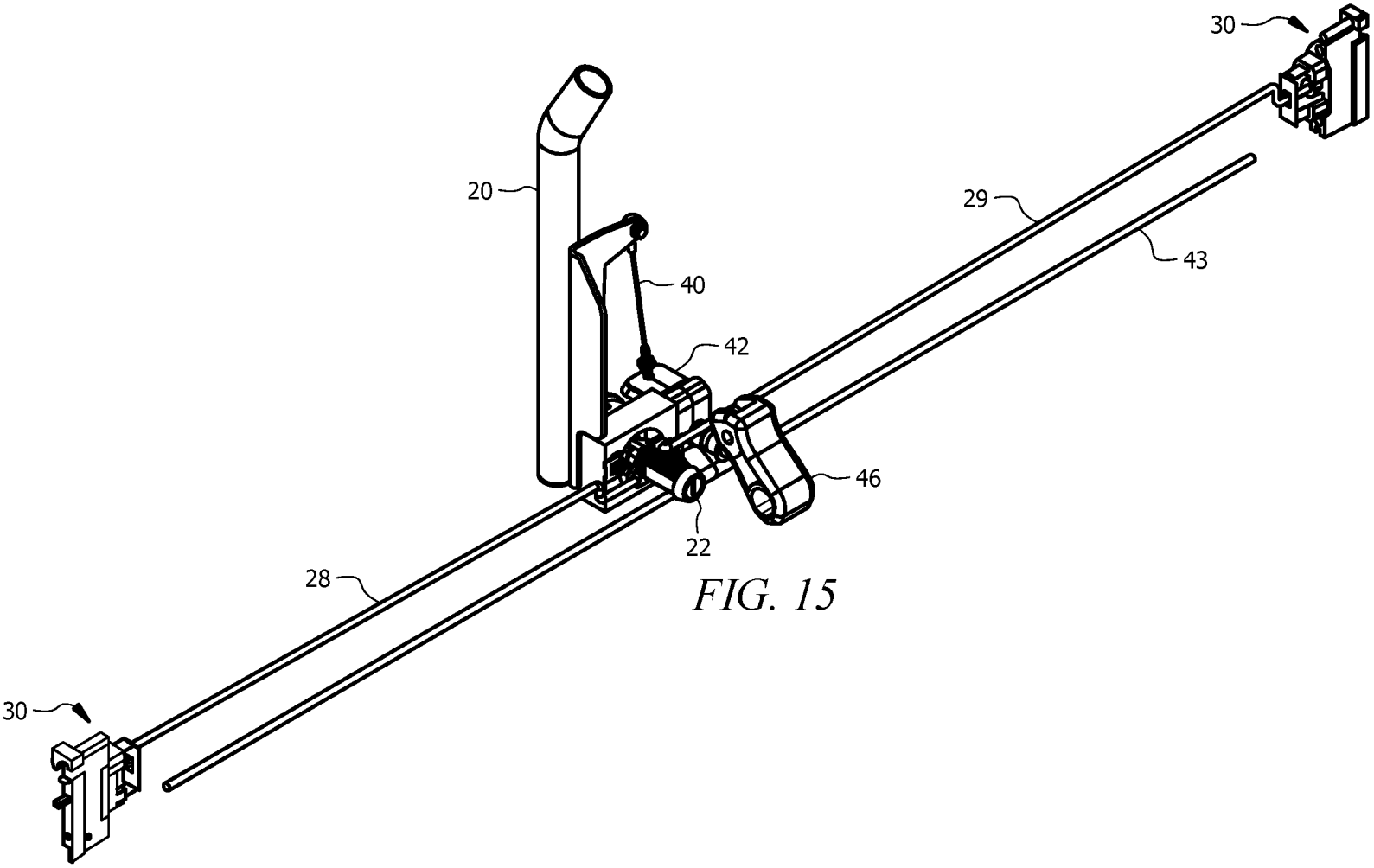
FIGS. 15-17 are additional front perspective views of an exemplary embodiment of the internal lock release according to the present disclosure.
Figure 16:
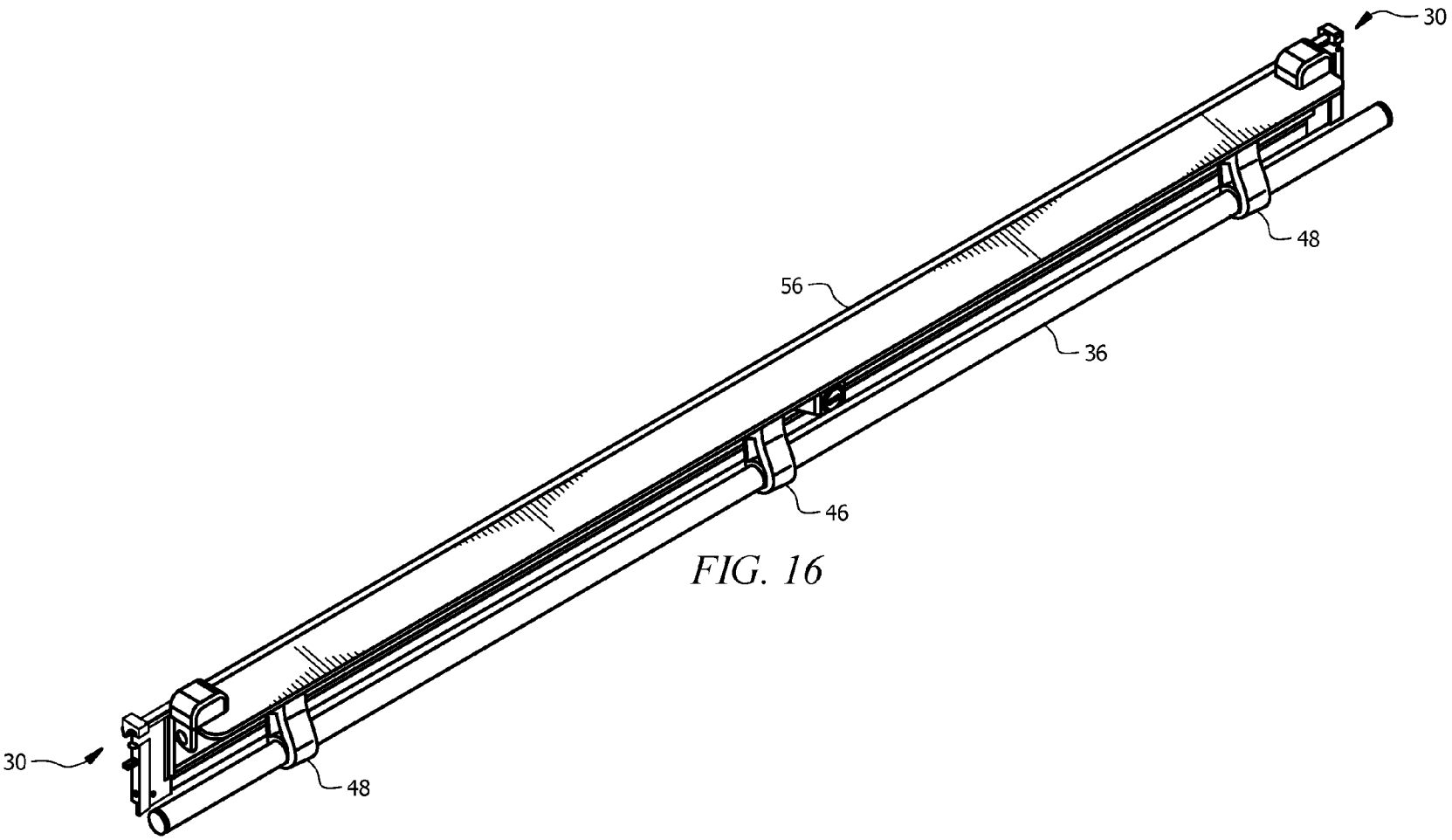
Figure 17:
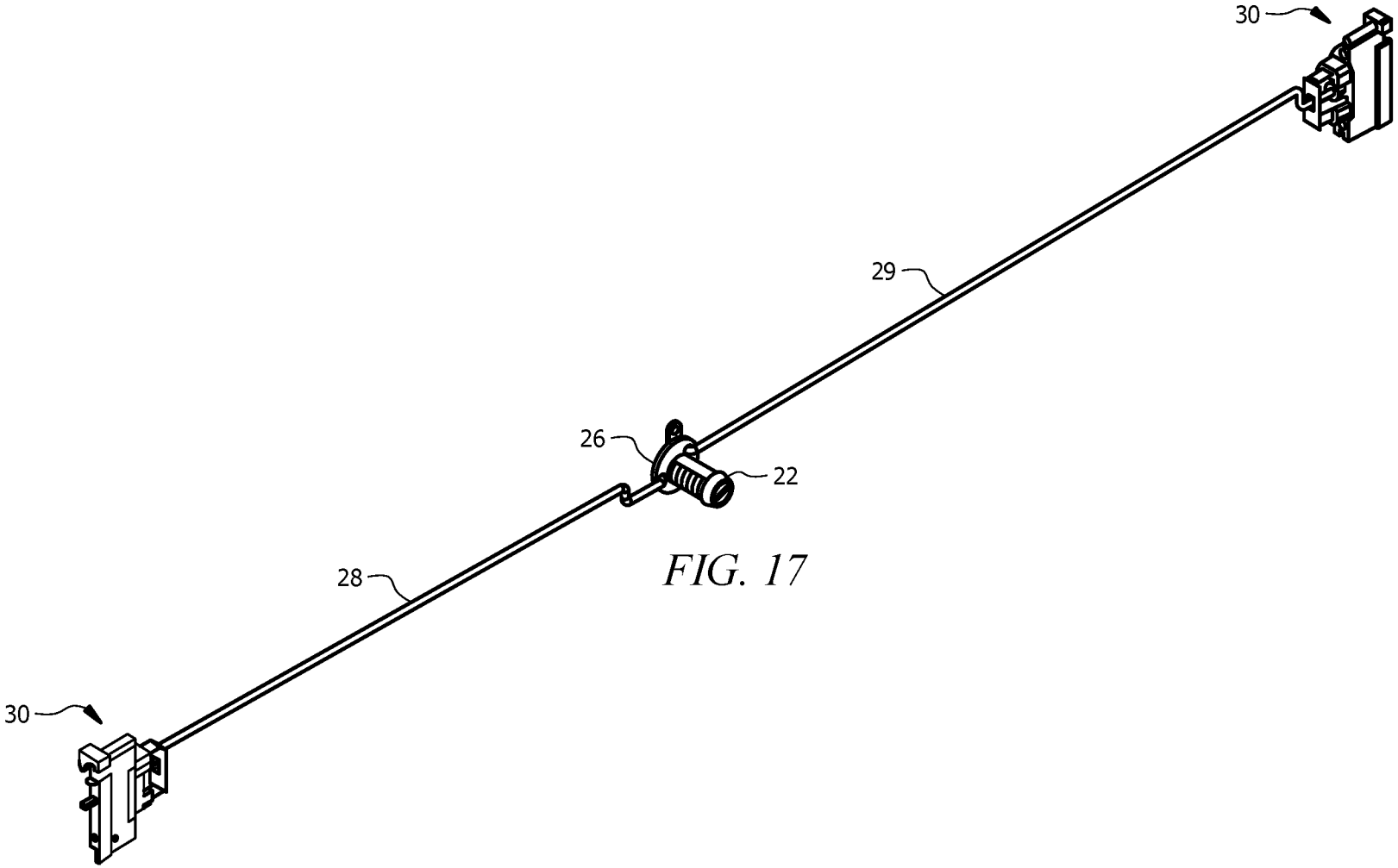

Referring also to the various views presented in FIGS. 2-17 with the roll-up door hidden from view for the sake of an unobstructed view, the internal lock release mechanism 12 is located on the inside surface of the door 10. The internal lock release mechanism 12 includes a lift arm 20 disposed on the interior side of the door 10 that is in the horizontal stowed position when it is not in use (e.g., FIG. 9), and is in the vertical position when it is deployed (e.g., FIGS. 1 and 10) to unlock an electrical lock on the door 10.

To unlock the door 10 by a user standing outside the vehicle cargo compartment, a key (not shown explicitly) is inserted into the lock cylinder 22 (see e.g., FIG. 2) and rotated, which causes a lock dog 24 to engage a lock cam 26 of the lock and rotate it. The rotational motion of the lock cam 26 causes the left and right lock rods 28 and 29 to retract from a spring-loaded mechanism 30 mounted in the left and right sides of the door frame 16 and controlled by an electrical lock, and thus unlocking the door. The user then manually raises a lift bar 36 disposed horizontally across the width of the door 10 so that the lift bar 36 clears the stationary strike blocks 38 located (see FIG. 1) on either side of the door 10 on the door frame 16, allowing the shutters to roll up. The stationary strike blocks 38 function like a mechanical door latch for the roll-up door 10. This operation unlocks the door 10 from the outside using a key (not explicitly shown). While the user unlocks the door from the outside, the lift arm 20 disposed on the interior surface of the roll-up door 10 remains stationary in the stowed horizontal position during this operation. Similarly, when locking the door 10, the lock cylinder 22 is turned with the key, which causes the lock cam 26 to rotate and extend the lock rods 28 into the spring-loaded mechanism 30 located in the door frame. The lock 22 and lift arm 20 operate independently.

In operation to unlock the door 10 from inside the vehicle cargo compartment, an internal release mechanism 12 is provided for a mechanical override or bypass of the lock 22.

Raising (rotating) the lift arm 20 disposed on the interior surface of the door 10 from the stowed (horizontal) position to the deployed (vertical) position causes a cable 40 attached between the lift arm 20 and a release bar pivot 42 to pull on the release bar pivot 42 to pivot or rotate about an axis along a pivot rod 43. The release bar pivot 42 is disposed in the interior of the vehicle compartment, but is coupled to the pivot rod 43 located outside the vehicle compartment. The pivoted release bar pivot 42 in turn pushes against a push rod 44 and causes it to be displaced outward away from the door 10 and toward a center pivot block 46 disposed outside the door 10. The center pivot block 46 is pivoted outward from the door 10 and in turn causes a lift bar 36 that passes through the center pivot block 46 as well as the left and right pivot blocks 48 to automatically raise out and up from under the stationary strike blocks 38 (see FIG. 1) located outside the vehicle compartment and on either side of the door 10. At the same time, the ramps on the lock dog 24 of the lock 22 to disengage from the lock cam 26 as the lock cam 26 is turned. A spring 52 housed within the internal release housing 54 of the lock 22 maintains pressure against the lock cam 26 so it re-engages the lock dog 24 as the lift arm 20 is returned to the stowed horizontal position. The rotation of the lock cam 26 enables the left and right lock rods 28 attached to the lock cam 26 to retract from the spring-loaded mechanism 30 located at the left and right sides of the door frame 16 so that the door can be rolled up.

The length of the cable assembly 40 attached to the lift arm 20 can be adjustable so that the left and right lock rods 28 and 29 can retract before the lift bar 36 is raised from under the stationary strike blocks 36. This adjustability prevents the lock rods 28 and 29 from jamming and ensures smooth operation.

It should be noted that the internal lock release mechanism 12 is a mechanical override or bypass of a lock that is electrically powered and controlled, as well as manipulating the lift bar to clear a mechanical stop (the station strike blocks 36). As shown in FIGS. 7-10 and 16, the exterior portions of the internal lock release mechanism 12 may be contained in a framed structure 56 that helps to shield it from the elements and tampering.

The features of the present invention which are believed to be novel are set forth below with particularity in the appended claims. However, modifications, variations, and changes to the exemplary embodiments described above will be apparent to those skilled in the art, and the internal lock release mechanism described herein thus encompasses such modifications, variations, and changes and are not limited to the specific embodiments described herein.

What is claimed is:

1. An internal release mechanism for a truck roll-up door closure to a vehicle compartment, comprising:

a rotatable lift arm disposed on the roll-up door inside the vehicle compartment having a stowed position and a deployed position;

a cable coupled to the lift arm;

a release bar pivot coupled to the cable and operable to pivot in response to the cable being raised by the lift arm being moved from the stowed position to the deployed position;

a push rod disposed through the roll-up door and operable of being engaged and pushed by the release bar pivot in response to the cable being raised by the lift arm being moved from the stowed position to the deployed position;

a center pivot block disposed outside the vehicle compartment operable of being engaged and pivotally displaced by the push rod;

a lift bar disposed outside the vehicle compartment and engaged with the center pivot block and being lifted clear of strike blocks disposed in the door frame;

a lock having a lock cam disposed outside of the vehicle compartment indirectly coupled to the lift arm and operable to rotate in response to the lift arm being moved from the stowed position to the deployed position;

a lock dog coupled to the lock cam and configured to disengage from the lock cam in response to the rotating lock cam; and a pair of lock rods disposed outside the vehicle compartment and coupled to the lock cam, and operable to retract from a spring-loaded mechanism disposed in the door frame of the roll-up door in response to the lock cam rotation.

2. A vehicle, comprising:

a vehicle compartment having a door opening and a door frame;

a roll-up door closure operable to roll up and down along the door frame to uncover and cover the door opening;

a lift arm disposed on an interior surface of the roll-up door having a stowed position and a deployed position;

a lift bar disposed outside the vehicle compartment and coupled to the lift arm and being lifted clear of strike blocks disposed in the door frame in response to the lift arm being displaced from the stowed position to the deployed position;

a lock having a lock cam disposed on an exterior surface of the roll-up door and indirectly coupled to the lift arm, the lock cam operable to rotate in response to the lift arm moving from the stowed position to the deployed position; and a pair of lock rods coupled to the lock cam disposed outside the vehicle compartment, and operable to retract from a spring-loaded mechanism disposed in the door frame of the roll-up door in response to the lock cam rotation.

3. The vehicle of claim 2, comprising a cable mechanism having a cable coupled between the lift arm and a release bar pivot coupled to the cable and operable to pivot in response to the cable being raised by the lift arm from the stowed position to the deployed position.

4. The vehicle of claim 3, comprising a center pivot block disposed outside the vehicle compartment operable of being engaged and pivotally displaced by a push rod engaged and displaced by the release bar pivot in response to the lift arm being displaced from the stowed position to the deployed position, the center bar pivot operable to displace the lift bar and clear the strike blocks disposed in the door frame.

5. An internal release mechanism for a truck roll-up door closure to a vehicle compartment, comprising:

a lift arm disposed on the roll-up door inside the vehicle compartment having a stowed position and a deployed position;

a first release mechanism coupled to the lift arm operable to bypass a door lock disposed outside the vehicle compartment in response to the lift arm being moved by an occupant inside the vehicle compartment from the stowed position to the deployed position;

a second release mechanism coupled to the lift arm operable to clear a mechanical door latch disposed outside of the vehicle compartment also in response to the lift arm being moved from the stowed position to the deployed position; and wherein the second release mechanism comprises:

a cable coupled to the lift arm;

a release bar pivot coupled to the cable and operable to pivot in response to the lift arm being moved from the stowed position to the deployed position; and a push rod disposed through the roll-up door and operable of being engaged and pushed by the release bar pivot in response to the lift arm being moved from the stowed position to the deployed position.

6. The internal release mechanism of claim 5, wherein the first release mechanism comprises:

a lock cam disposed on the roll-up door and coupled to the lift arm and operable to rotate in response to the lift arm rotating to the deployed position;

a lock dog coupled to the lock cam and configured to disengage from the lock cam in response to the rotating lock cam; and a pair of lock rods disposed outside the vehicle compartment and coupled to the lock cam, and operable to retract from locking fingers disposed in the door frame of the door in response to the lock cam rotation.

7. The internal release mechanism of claim 5, wherein the second release mechanism further comprises:

a center pivot block disposed outside the vehicle compartment operable of being engaged and pivotally displaced by the push rod; and a lift bar disposed outside the vehicle compartment and engaged with the center pivot block and being lifted clear of strike blocks disposed in the door frame in response to the center pivot block displacement.

* * * * *